US007679017B1

(12) United States Patent
Tsai

(10) Patent No.: US 7,679,017 B1
(45) Date of Patent: Mar. 16, 2010

(54) SWITCH STRUCTURE

(75) Inventor: Tung-Chi Tsai, Taipei Hsien (TW)

(73) Assignee: Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 12/414,614

(22) Filed: Mar. 30, 2009

(30) Foreign Application Priority Data

Aug. 20, 2008 (CN) ..... 2008 1 0304067

(51) Int. Cl.
*H01H 15/10* (2006.01)

(52) U.S. Cl. ..... 200/547; 200/331; 200/329

(58) Field of Classification Search ..... 200/5 R, 200/537, 547–551, 296, 329–331, 17 R; 345/168, 345/169, 184, 156
See application file for complete search history.

(56) References Cited

U.S. PATENT DOCUMENTS 4,880,950 A * 11/1989 Carson et al. ..... 200/547
5,969,309 A * 10/1999 Nishimura et al. ..... 200/16 C
6,079,865 A * 6/2000 Plavcan et al. ..... 366/129
7,012,205 B1 * 3/2006 Han ..... 200/252
7,208,692 B2 * 4/2007 Yamaguchi ..... 200/547
7,557,319 B2 * 7/2009 Zadesky et al. ..... 200/331

* cited by examiner

*Primary Examiner*—Michael A Friedhofer
(74) *Attorney, Agent, or Firm*—Zhigang Ma

(57) ABSTRACT

A switch structure includes a switch body, a holding member, a torsion member, and a swinging lever. The switch body includes a base included a front surface and a rear surface, a pushing portion, two fixing portion, each fixing portion defining a guiding slot. The holding member defines two cavities. The switch body is rotatably installed onto the holding member by inserting the fixing portion into the cavity. The torsion member includes two elastic arms and a connecting pole, one of the elastic arm is hooked to the holding member. The swinging lever includes a first end movably connected to the switch body, a second end movably connected to the other elastic arm, and a connecting portion connecting the first and second end, the swinging lever rotatably installed to the holding member via the connecting portion.

14 Claims, 3 Drawing Sheets

SWITCH STRUCTURE

BACKGROUND

1. Technical Field

The present disclosure relates to a switch structure.

2. Description of the Related Art

Many electronic devices include a side switch for triggering/inputting control instructions. When designing such side switches, button segment feeling (reaction effect provided by the side switch to a user) is a main factor to be considered. However, current side switches usually cannot provide desirable button segment feeling.

Therefore, what is desired is a switch structure that can overcome the above described problem.

DETAILED DESCRIPTION

Figure 1:
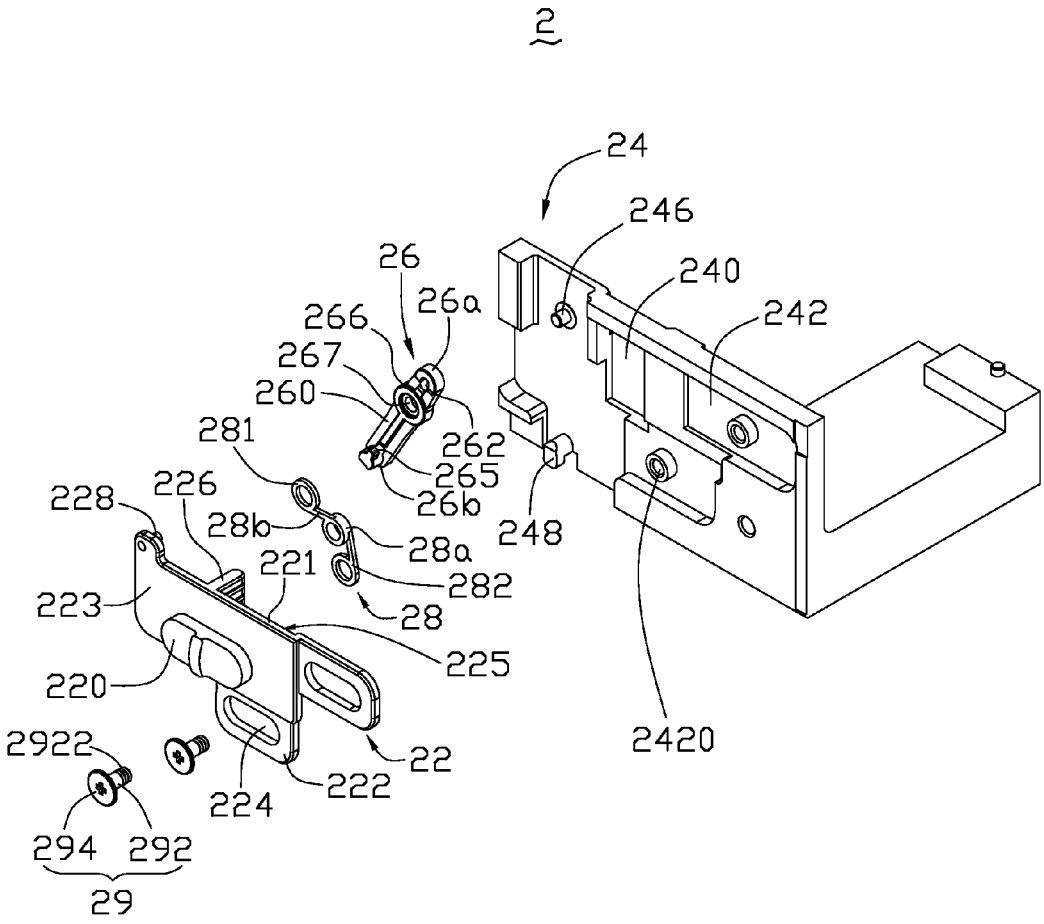
FIG. 1 is an exploded, isometric, schematic view of a switch structure, according to an exemplary embodiment.

Referring to FIG. 1, a switch structure 2 in accordance with an exemplary embodiment is illustrated. The switch structure 2 includes a switch body 22, a holding member 24, a swinging lever 26, and a torsion member 28. The switch body 22, holding member 24, and swinging lever 26 are assembled onto the holding member 24.

The switch body 22 includes a base 221, a pushing portion 220, two fixing portions 222, a flange 226, and a locating pin 228. The base 221 is substantially rectangular in shape and includes a front surface 223, and a rear surface 225 facing away from the front surface 223. The pushing portion 220 is integrally formed with the base 221, and extends outwardly from the front surface 223. The two fixing portions 222 are integrally formed with the base 221. Each fixing portion 222 extends outwardly from a sidewall of the base 221. The extending direction of both the fixing portions 222 is substantially parallel to the front and rear surfaces 223, 225. Each of the fixing portions 222 defines a guiding slot 224. The guiding direction of the guiding slots 224 is substantially parallel to the longitudinal direction of the fixing portion 222. The flange 226 is also integrally formed with the base 221, and extends outwardly from the rear surface 225. The locating pin 228 is integrally formed with the base 221 and extends outwardly from a corner of the rear surface 225.

The holding member 24 defines a through hole 240, two cavities 242, and includes a column 246, two screw-receiving portions 2420, and a second hook 248. The second hook 248 extends outwardly from the bottom of the holding member 24. Each screw-receiving portion 2420 is received in a corresponding cavity 242.

In other embodiment, the holding member 24 can also have only one cavity 242 and only one screw-receiving portion 2420, and the switch body 22 can also have only one guiding slot 224 correspondingly.

The swinging lever 26 includes a first end 26*a*, a second end 26*b*, a connecting pole 260 connecting the first end 26*a* and the second end 26*b*, and a first hook 265. The first end 26*a* defines a latching hole 262 configured for fittingly receiving the locating pin 228. The first hook 265 is integrally formed with the second end 26*b*. The swinging lever 26 further includes a projector 266 extending upward therefrom near the first end 26*a*. The projector 266 defines a round hole 267, the inner diameter of the round hole 267 is substantially equal to the diameter of the column 246.

The torsion member 28 includes two elastic arms 28*b* and a connecting portion 28*a* positioned between the two elastic arms 28*b*. One of the arms 28*b* includes a first ring 281 matching with the first hook 265. The other arm 28*b* includes a second ring 282 matching with the second hook 248.

The switch structure 2 further includes two screws 29. Each of the screws 29 includes a sliding pole 292 with screw threads 2922 defined at one end and a cap 294 formed on the other end of the sliding pole 292. In this embodiment, the length of the screw 29 is larger than the height of the screw-receiving portion 2420 of the holding member 24.

In assembly, the first ring 281 is hooked to the first hook 265. The second ring 282 is hooked to the second hook 248. Then, the column 246 rotatably inserts through the round hole 267. Thereby, the swinging lever 26 is rotatably attached to the holding member 24. The latching pin 228 rotatably insert through latching hole 262. Thereby, the swinging lever 26 is rotatably linked to the switch body 22. The flange 226 is movably received in the through hole 240. Each of the two fixing portions 222 is movably received in a corresponding cavity 242. Each of the two screws 29 inserts through a corresponding slot 224 and is threadedly engaged with a corresponding screw-receiving portion 2420. In this embodiment, the fixing portions 22 can be mounted to the holding member 24 and can be slid along the guiding direction of the cavities 242 in the cavities 242, because the height of the threaded hole of the screw-receiving portions 2420 is substantially equal to the total depth of the cavity 242, as well as the cross-sectional size of the guiding slot 224 of the switch body 22 being larger than the diameter of the sliding poles 292.

Figure 2:
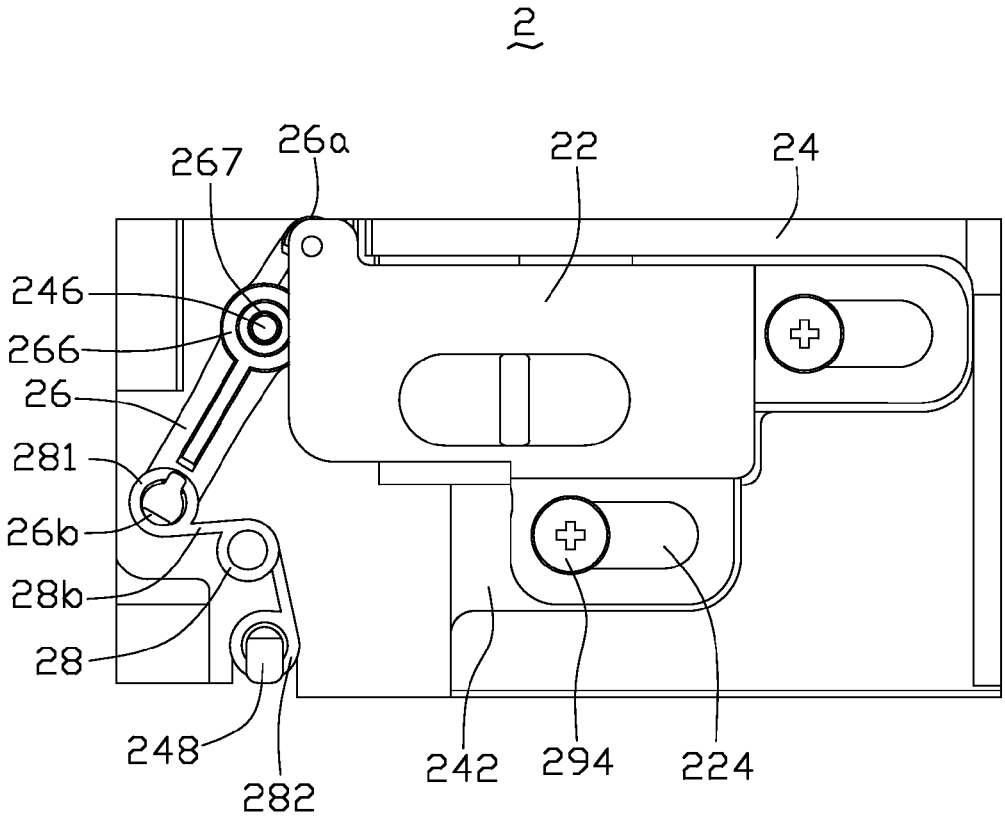
FIG. 2 is a planar, schematic view of the switch structure of FIG. 1, which is in a first state.
Figure 3:
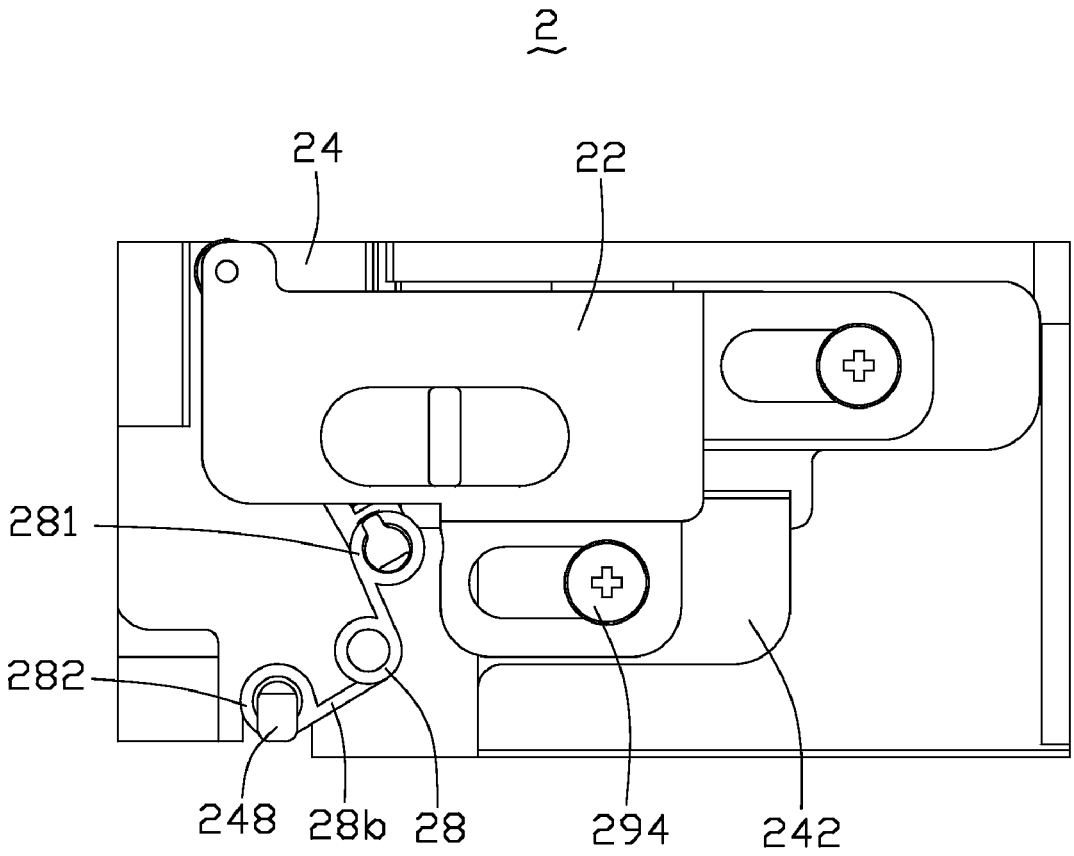
FIG. 3 is similar to FIG. 2, but showing the switch structure used in a second state.

Referring to FIGS. 2-3, in use, when a user pushes the pushing portion 220 to trigger control signal, the swinging lever 26 is driven to rotated about the column 246 by the pushing the switch body 22. As a consequence, the torsion spring 28 is deformed. This can bring excellent button segment feeling to the user. In detail, after the early half of the rotation trip of the second end 26*b* (i.e., when the second end 26*b* passes the lowest point of rotation trip), the deformed torsion spring 28 regains its original position/shape and forces the second end 26*b* rotating along pushing direction to the end of the trip.

It will be understood that the above particular embodiments and methods are shown and described by way of illustration only. The principles and the features of the present invention may be employed in various and numerous embodiments thereof without departing from the scope of the invention as claimed. The above-described embodiments illustrate the scope of the invention but do not restrict the scope of the invention.

What is claimed is:

1. A switch structure, comprising:

a switch body comprising a base comprising a front surface and a rear surface facing away from with the front surface, a pushing portion extending outwardly from the front surface, two fixing portion each extending outwards from a sidewall of the base along a direction substantially parallel to the front surface, each fixing portion defining a guiding slot;

a holding member defining two cavities for receiving the fixing portions correspondingly, the switch body slidably installed onto the holding member by slidably inserting the fixing portion into the cavity;

a torsion member comprising two elastic arms and a connecting pole positioned between the two elastic arms, one of the elastic arm hooked to the holding member; and a swinging lever comprising a first end movably connected to the switch body, a second end movably connected to the other elastic arm of the torsion member, and a connecting portion connecting the first and second end, the swinging lever rotatably installed to the holding member via the connecting portion.

2. The switch structure as claimed in claim 1, wherein further comprises two screws, the holding member further comprises two screw-receiving portion, each of the screw-receiving portions is received in a corresponding cavity, each of the screws comprises a sliding pole with screw threads defined at one end and being engaged with the corresponding screw-receiving portion of the holding member, and a cap formed on the other end of the sliding pole.

3. The switch structure as claimed in claim 2, wherein a height of screw-receiving portions is substantially equal to the total depth of the cavity and cross-sectional size of the guiding slot of the switch body is larger than the diameter of the sliding poles.

4. The switch structure as claimed in claim 1, wherein the base further comprises a locating pin integrally formed with the base and extending upward from a corner of the rear surface, the first end of the swinging lever defines a locating hole which is configured for fittingly receiving the locating pin, the swinging lever is movably connected to the switch body by inserting the latching pin into the locating hole.

5. The switch structure as claimed in claim 1, wherein the swinging lever further comprises a projector extending upward therefrom, the projector defines a round hole near the first end, the holding member further comprises a column, the inner diameter of the round hole is substantially equal to the diameter of the column, the swinging lever is capable of rotating around the column by inserting the round hole into the column.

6. The switch structure as claimed in claim 1, wherein the two arms respectively defines a first ring aligned and engaged with the first hook of the swinging lever, and a second ring, the holding member further comprises a second hook extending downward from the bottom of the holding member and engaged with the second ring.

7. The switch structure as claimed in claim 1, wherein the switch body further comprises a flange extended outwardly from the rear surface, the holding member further comprises a through hole corresponding to the location of the flange, the flange is capable of moving in the through hole.

8. A switch structure, comprising:

a switch body comprising a base comprising a front surface and a rear surface facing away from with the front surface, a pushing portion extending outwardly from the front surface, at least one fixing portions each extending outwards from a sidewall of the base along a direction substantially parallel to the front surface, each fixing portion defining a guiding slot;

a holding member defining at least one cavities for receiving the fixing portions correspondingly, the switch body slidably installed onto the holding member by slidably inserting the fixing portion into the cavity;

a torsion member comprising two elastic arms and a connecting pole positioned between the two elastic arms, one of the elastic arm hooked to the holding member; and a swinging lever comprising a first end movably connected to the switch body, a second end movably connected to the other elastic arm of the torsion member, and a connecting portion connecting the first and second end, the swinging lever rotatably installed to the holding member via the connecting portion.

9. The switch structure as claimed in claim 8, wherein further comprises at least one screws, the holding member further comprises at least one screw-receiving portion, each of the screw-receiving portions is received in a corresponding cavity, each of the screws comprises a sliding pole with screw threads defined at one end and being engaged with the corresponding screw-receiving portion of the holding member, and a cap formed on the other end of the sliding pole.

10. The switch structure as claimed in claim 9, wherein a height of screw-receiving portions is substantially equal to the total depth of the cavity and cross-sectional size of the guiding slot of the switch body is larger than the diameter of the sliding poles.

11. The switch structure as claimed in claim 8, wherein the base further comprises a locating pin integrally formed with the base and extending upward from a corner of the rear surface, the first end of the swinging lever defines a locating hole which is configured for fittingly receiving the locating pin, the swinging lever is movably connected to the switch body by inserting the latching pin into the locating hole.

12. The switch structure as claimed in claim 8, wherein the swinging lever further comprises a projector extending upward therefrom, the projector defines a round hole near the first end, the holding member further comprises a column, the inner diameter of the round hole is substantially equal to the diameter of the column, the swinging lever is capable of rotating around the column by inserting the round hole into the column.

13. The switch structure as claimed in claim 8, wherein the two arms respectively defines a first ring aligned and engaged with the first hook of the swinging lever, and a second ring, the holding member further comprises a second hook extending downward from the bottom of the holding member and engaged with the second ring.

14. The switch structure as claimed in claim 8, wherein the switch body further comprises a flange extended outwardly from the rear surface, the holding member further comprises a through hole corresponding to the location of the flange, the flange is capable of moving in the through hole.

* * * * *